US007040133B2

(12) United States Patent
Hu

(10) Patent No.: US 7,040,133 B2
(45) Date of Patent: May 9, 2006

(54) TRANSMISSION DEVICE FOR A TUBE BENDING MACHINE

(75) Inventor: Ping-Kun Hu, Tainan (TW)

(73) Assignee: Ying Lin Machine Industrial Co., Ltd., Tainan Hsien (TW)

( * ) Notice: Subject to any disclaimer, the term of this patent is extended or adjusted under 35 U.S.C. 154(b) by 231 days.

(21) Appl. No.: 10/689,939

(22) Filed: Oct. 20, 2003

(65) Prior Publication Data

US 2004/0099032 A1 May 27, 2004

(30) Foreign Application Priority Data

Nov. 22, 2002 (TW) ..... 91218920 U

(51) Int. Cl.
*B21D 7/04* (2006.01)
*B21J 13/10* (2006.01)

(52) U.S. Cl. ..... 72/149; 72/150; 72/420; 72/422

(58) Field of Classification Search ..... 72/149, 72/150, 151, 420, 422; 82/126, 127
See application file for complete search history.

(56) References Cited

U.S. PATENT DOCUMENTS 2,971,194 A * 2/1961 Hahn ..... 72/422
3,974,676 A * 8/1976 Eaton ..... 72/307
5,140,878 A * 8/1992 Fabbri ..... 82/127
5,426,965 A * 6/1995 Hopf ..... 72/149

* cited by examiner

*Primary Examiner*—Derris H. Banks
*Assistant Examiner*—Debra M Wolfe
(74) *Attorney, Agent, or Firm*—Dellett & Walters

(57) ABSTRACT

A transmission device for a tube bending machine include a first power means and a second power means mounted on the sliding seat to drive the sliding seat as well as a workpiece securely connected to the sliding seat to move. The second means has a second motor alternately connected to the clutch so that the transmission power is selectively transmitted to drive the sliding seat when required. Therefore, transmission of workpiece is smooth and the processing work to the workpiece is accomplished.

5 Claims, 9 Drawing Sheets

TRANSMISSION DEVICE FOR A TUBE BENDING MACHINE

BACKGROUND OF THE INVENTION

1. Field of the Invention

The present invention relates to a transmission device, and more particularly to transmission device for a tube bending machine. The transmission device has a first power means and a second power means to drive the moving device to move along the guiding track, wherein the motor of the second power means is controlled by a clutch so that a boost is provided to the moving device and thus a tube is able to be successfully bent.

2. Description of Related Art

A tube bending machine is specially used in the work of tube bending processes. When the workpiece (the tube) is being bent, the outer periphery of the workpiece is being stretched and the inner periphery of the workpiece is being compressed. In order to prevent the workpiece from being torn apart during the bending process, usually a fast conveying speed and large boost are provided by the tube bending machine.

U.S. Pat. No. 5,426,965 "Carriage Boost Drive" discloses, with reference to FIGS. 8 and 9 of this present application, a tube bending device (41) having a tube bending module (411) on top of a base (40) and a clamping module (42) on the side of the tube bending module (411). A transmission device (50) is mounted on the base (40) opposite to the tube bending device (41) and has a sliding seat (52) slidable along a sliding track (51) on top of the base (40) and an auxiliary booster (53) on the distal end of the sliding seat (52). The sliding seat (52) has a mounting element (521) extending through the sliding seat (52) for mounting the tube (60) thereon and the auxiliary booster (53) has a cylinder (531) with a connector (532) to connect to the mounting element (521). A locking device (54) is mounted at the distal end of the auxiliary booster (53) to control the cylinder (531).

When the conventional tube bending machine is employed, the mounting element (521) clamps one end of the tube (60), the other end of which is facing the tube bending module (411). Then the motor of the sliding seat (52) drives the booster (53) and the locking device (54) to move toward the tube bending module (411) along the sliding track (51). After the predetermined portion of the tube (60) is aligned with the tube bending module (411), the sliding seat (52) is controlled to stop movement and the cylinder (531) of the auxiliary booster (53) is locked by the locking device (54). Thereafter, the oil pressure from the cylinder (531) drives the tube (60) to move toward the tube bending module (411) via the connector (532) and the mounting element (521). Thus the tube (60) is able to be bent according to the predetermined shape. After the tube (60) is bent, the tube bending device (41) and the clamping device (42) leave the tube (60) and the mounting element (521) releases the tube (60). The cylinder (531) is controlled to move rearward to pull back the mounting element (521). Then the locking device (54) is unlocked and the motor of the sliding seat (52) drives the sliding seat (52) and the auxiliary booster (53) back to their original positions.

Although the conventional tube bending machine is able to provide a fast drive to the tube when the tube is transported to the tube bending device and a slow bending process, the tube bending process is limited due to the length of the cylinder.

To overcome the shortcomings, the present invention tends to provide an improved transmission device for a tube bending machine to mitigate the aforementioned problems.

SUMMARY OF THE INVENTION

The primary objective of the present invention is to provide an improved transmission device having a first power means with a first motor shaft extending through the moving plate to mate the first transmission gear with the first rack and a second power means controlled by a clutch to mate with the second transmission gear with the second rack.

Other objects, advantages and novel features of the invention will become more apparent from the following detailed description when taken in conjunction with the accompanying drawings.

DETAILED DESCRIPTION OF THE PREFERRED EMBODIMENT

Figure 1:
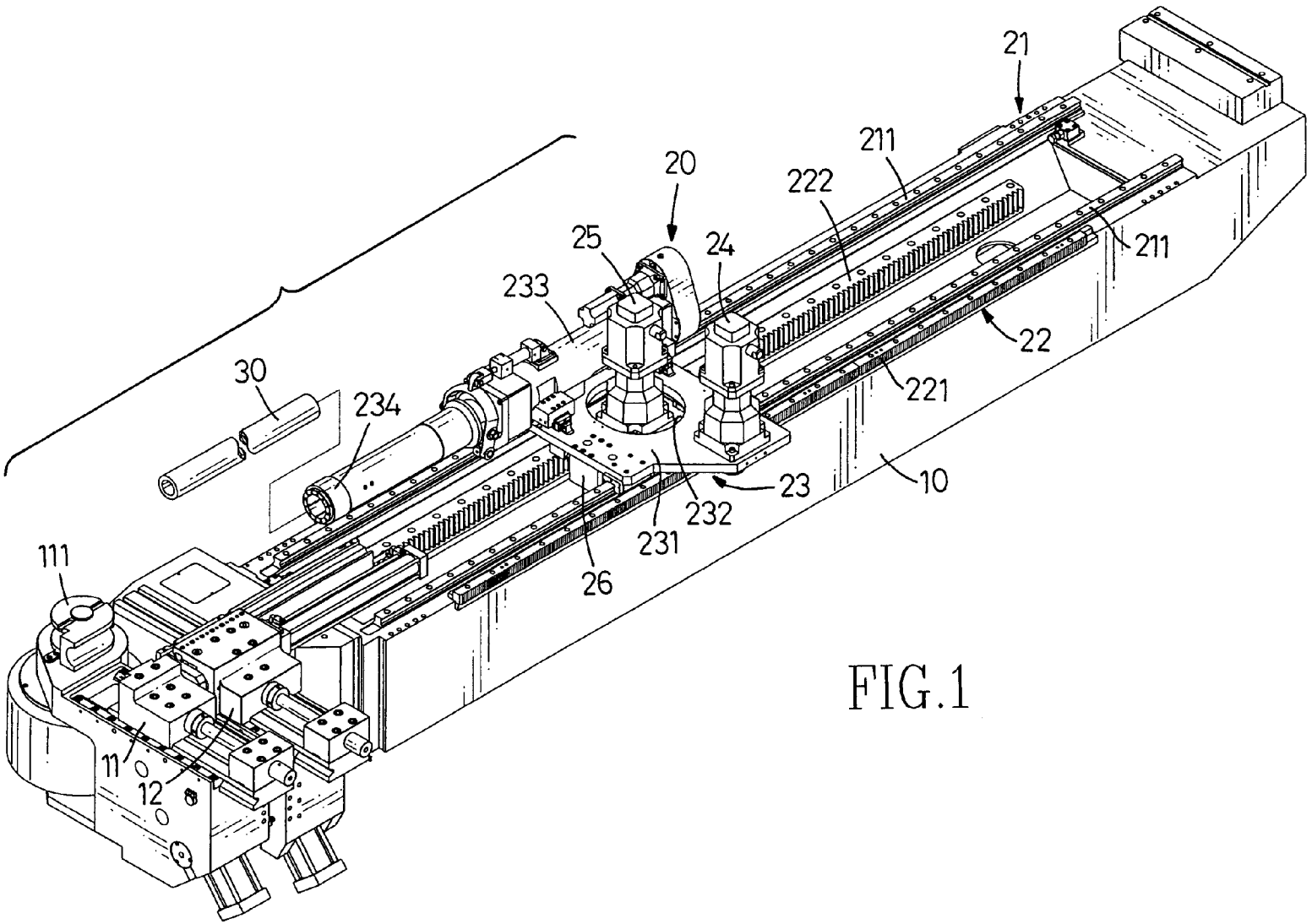
FIG. 1 is a perspective view showing the transmission device of the present invention being mounted on a tube bending machine.

With reference to FIG. 1, the transmission device (20) in accordance with the present invention is mounted on a base (10) of a tube bending machine having a tube bending device (11) with a bending mold (111) and a clamping device (12) both mounted on one end of the base (10), and further having a guiding track assembly (21), a rack assembly (22), a sliding seat (23) movable along the guiding track assembly (21), a first power means (24) mounted on the sliding seat (23) to drive the sliding seat (23) and a second power means (25) mounted on the sliding seat (23) to drive the sliding seat (23) to move and controlled by a clutch (26).

The guiding track assembly (21) may be provided with a single guiding track or a pair of mutually horizontal guiding tracks (211). The rack assembly (22) is provided with a first rack (221) and a second rack (222) horizontal to the first rack (221).

Figure 2:
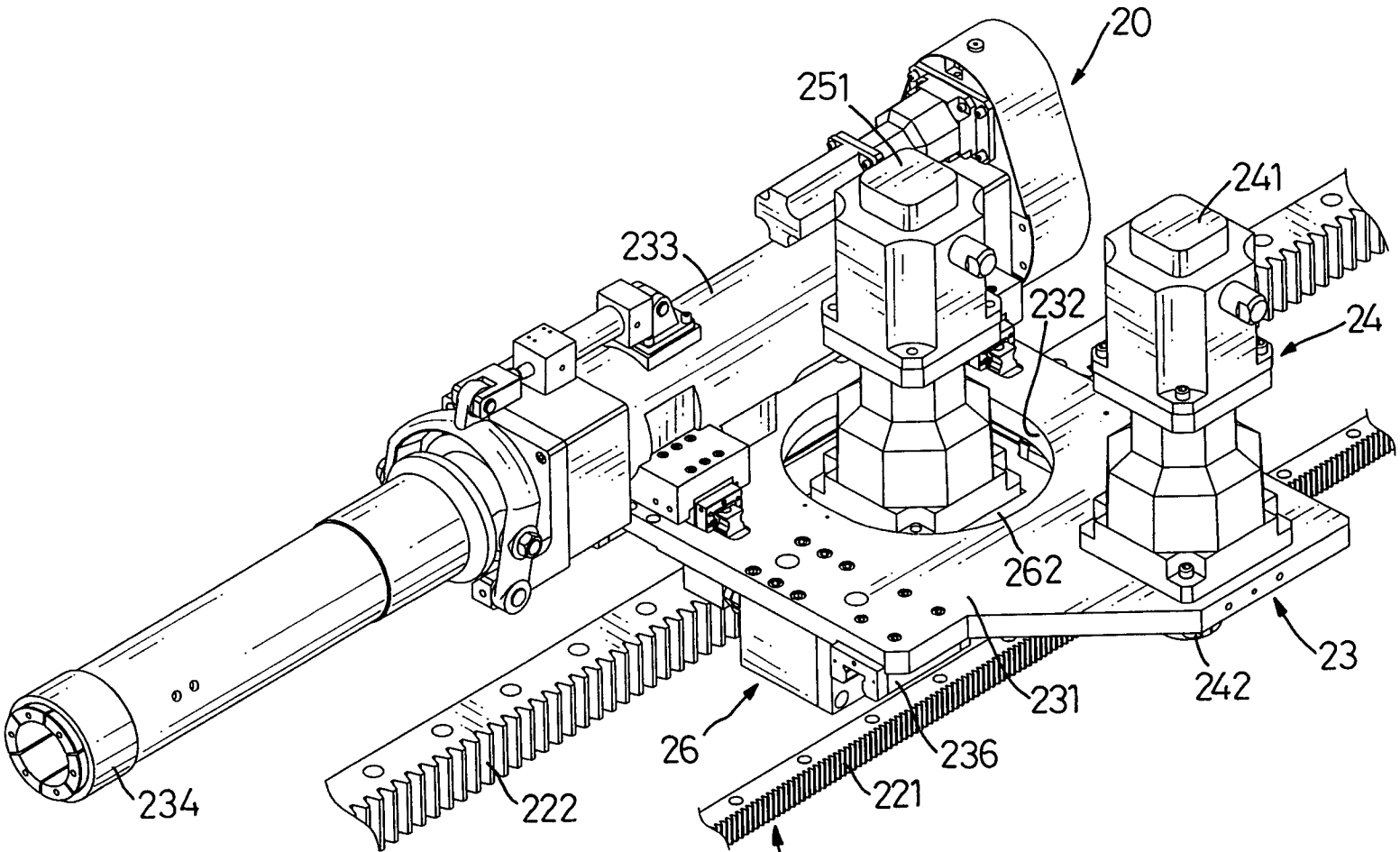
FIG. 2 is an exploded perspective view of the transmission device in accordance with the present invention.

With reference to FIG. 2, the sliding seat (23) has a moving plate (231) mounted on top of and movable relative to the guiding track assembly (21) and the rack assembly (22). The moving plate (231) has a through hole (232), a slider (236) mounted on a bottom face of the moving plate (231) and movable along the guiding track assembly (21)

and a clamping device (233) with a tube clamp (234) on top of the moving plate (231) for clamping a tube (30).

Figure 3:
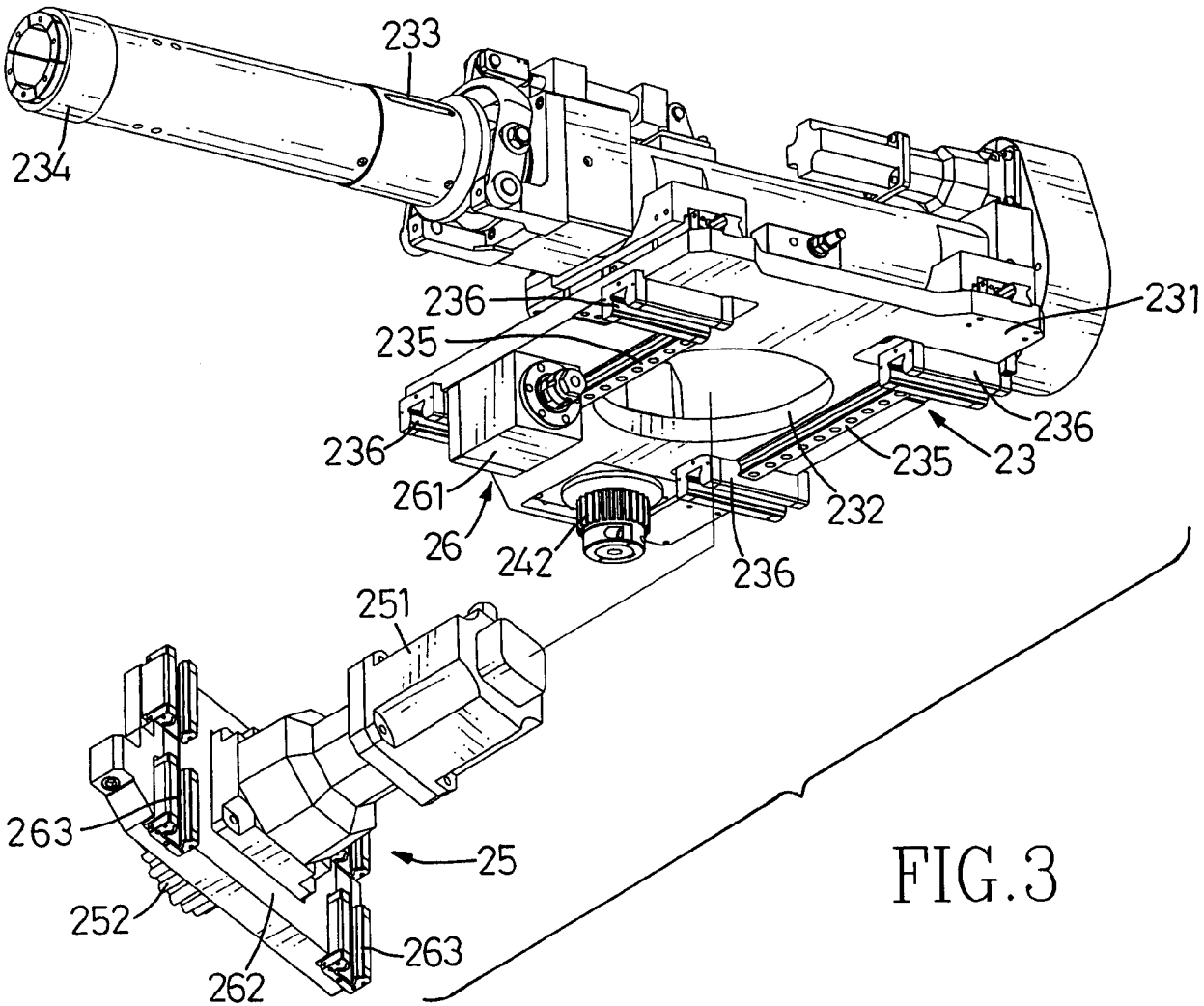
FIG. 3 is an exploded perspective view from a bottom angle of the transmission device in FIG. 2 wherein the racks are removed for clarity.
Figure 4:
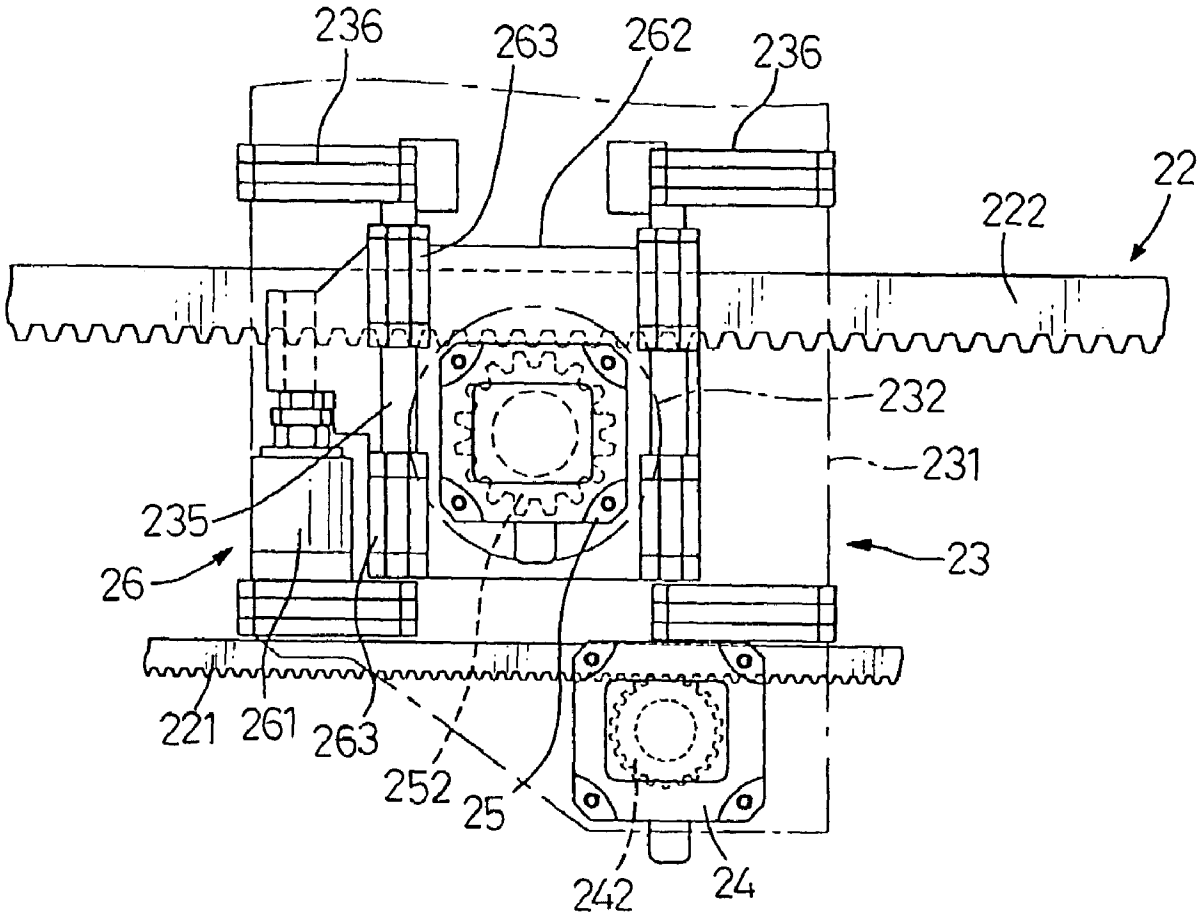
FIG. 4 is a schematic top plan view showing the assembled transmission device of the present invention.

With reference to FIGS. 2, 3 and 4, the first power means (24) has a first motor (241) having a motor shaft extending through the moving plate (231) to mate with a first transmission gear (242) which is meshed with the first rack (221) such that the sliding seat (23) is able to move along the guiding track assembly (21). It may be appreciated that the first power means may be a combination of a motor and a chain or a belt, which is able to accomplish the same goal to drive the sliding seat (23) to move as described.

The second power means (25) is received in the through hole (232) and mounted on the moving plate (231) via a clutch (26) having a cylinder (261). The cylinder (261) has a cylinder shaft (not shown) connected to an auxiliary bracket (262) provided under the through hole (232) and controlled by the cylinder (261) to move back and forth on the second rack (222). The second power means (25) has a motor shaft (not shown) extending through the auxiliary bracket (262) to combine with a second transmission gear (252) such that the cylinder (261) is able to control the mating of the second transmission gear (252) with the second rack (222) via the auxiliary bracket (262).

The auxiliary bracket (262) has an auxiliary sliding block (263) mounted on a top of the auxiliary bracket (262) to mate with an auxiliary guiding track (235) on a bottom of the moving plate (231) and vertical to the second rack (222).

With reference to FIGS. 1, 2 and 4, when the transmission device of the present invention is applied to the tube bending machine, the clutch (26) controls the second transmission gear (252) to disengage with the mating relationship with the second rack (222) via the auxiliary bracket (262), and the tube clamp (234) of the clamping device (233) is securely connected to one end of the tube (30) to allow the other end of the tube (30) to face the bending module (111) of the tube bending device (11). Then the first power means (24) on the sliding seat (23) is operated to drive the first transmission gear (242) to move along the first rack (221) toward the bending module (111).

Figure 5:
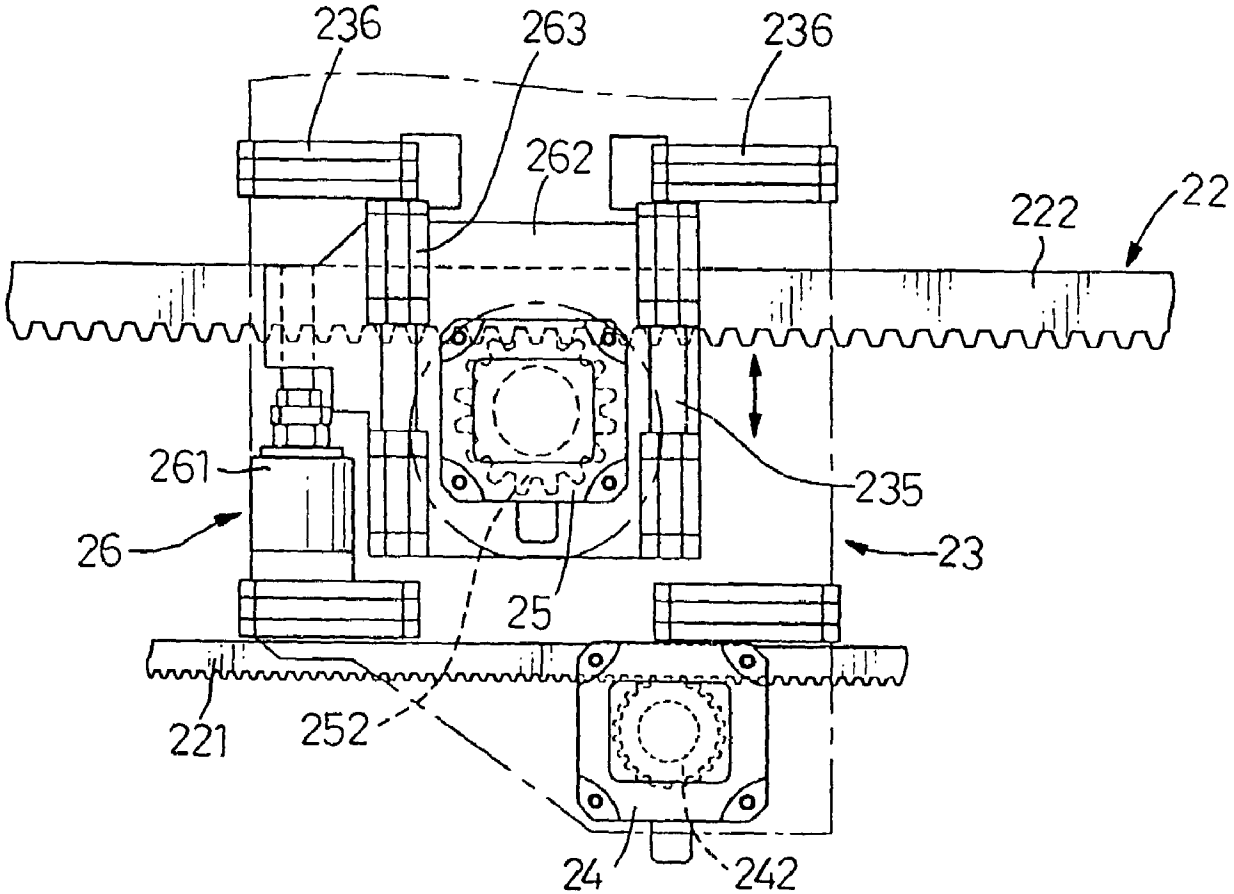
FIG. 5 is a schematic view showing the application of the transmission device of the present invention.

After the predetermined portion of the tube (30) reaches the bending module (111), the first motor (241) is stopped and the cylinder (261) of the clutch (26) pushes the auxiliary bracket (262) to the second rack (222) to allow the second transmission gear (252) to mate with the second rack (222), as shown in FIG. 5. Then the second motor (251) of the second power means (25) drives the second transmission gear (252) to push the tube (30) to move via the sliding seat (23). Forces including pressing and stretching to the tube (30) applied to the side of the tube bending device (11) and the clamping device (12) are able to bend the tube (30) according to the bending module (111).

After the tube (30) is bent, the tube bending device (11) and the clamping device (12) disengage from the tube (30) and the tube clamp (234) on the clamping device (233) releases the bent tube (30). Then, the clutch (26) drives the second transmission gear (252) of the second power means (25) to disengage from the second rack (222) and the first motor (242) of the first power means (24) drives the sliding seat (23) and the second power means (25) to move to their original positions to complete the bending process.

Figure 6:
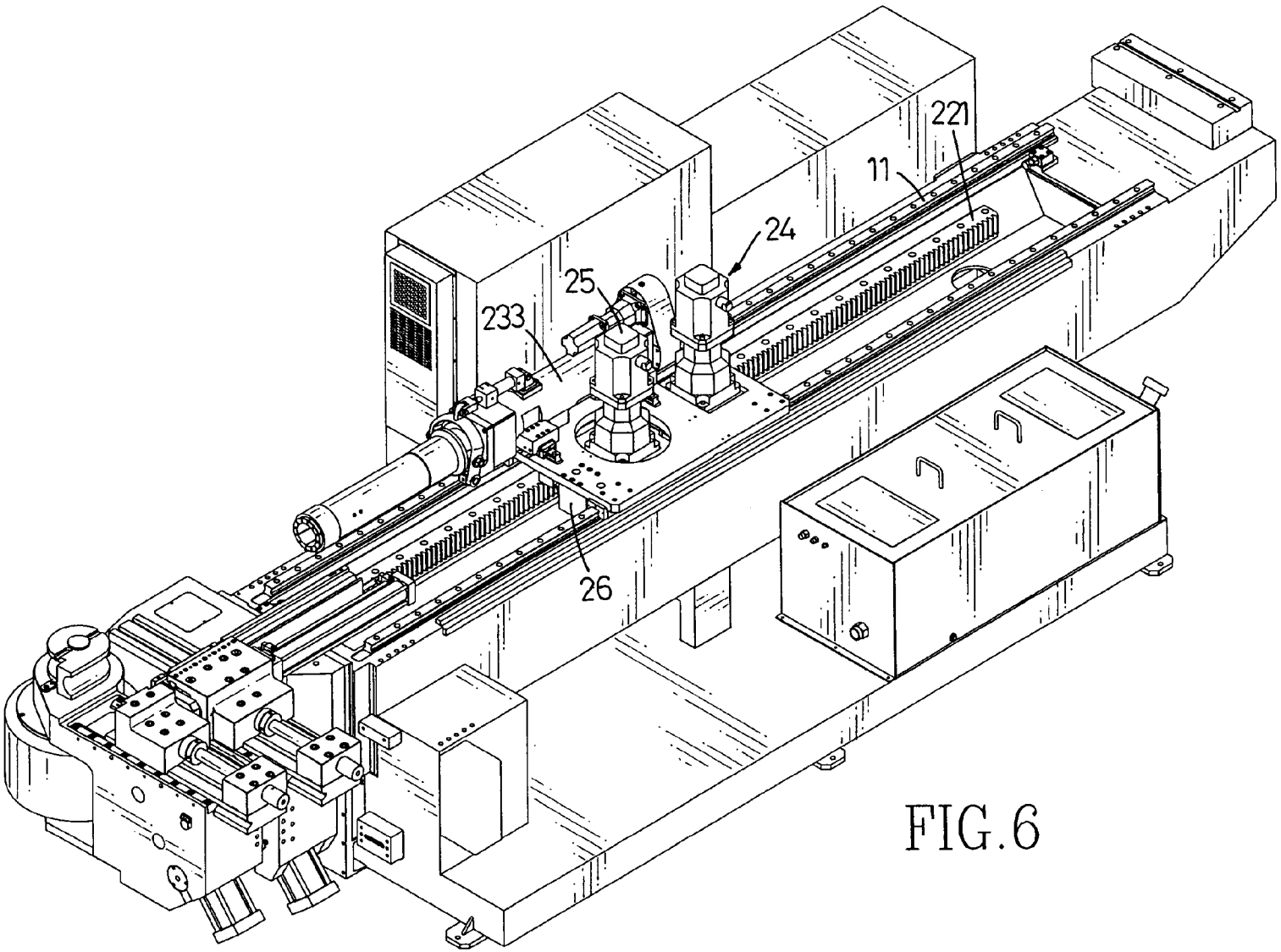
FIG. 6 is a perspective view showing another embodiment of the transmission device of the present invention.
Figure 7:
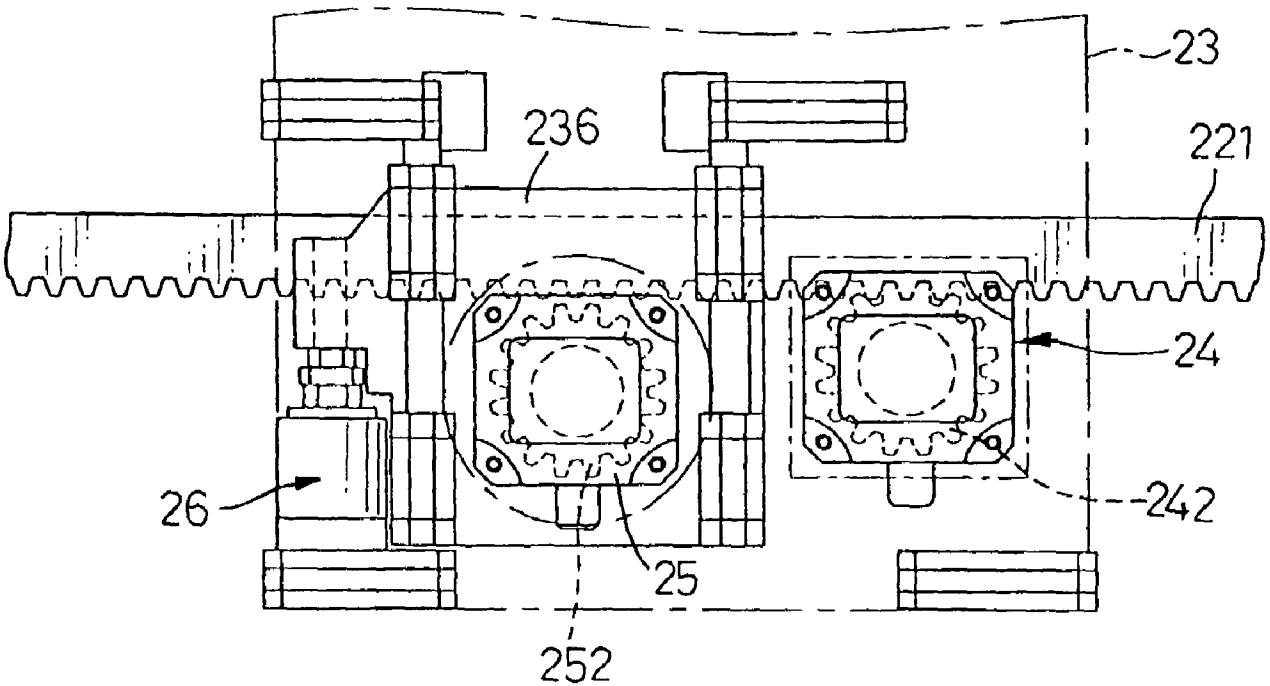
FIG. 7 is a top plan view of a partial of the embodiment in FIG. 6.
Figure 8:
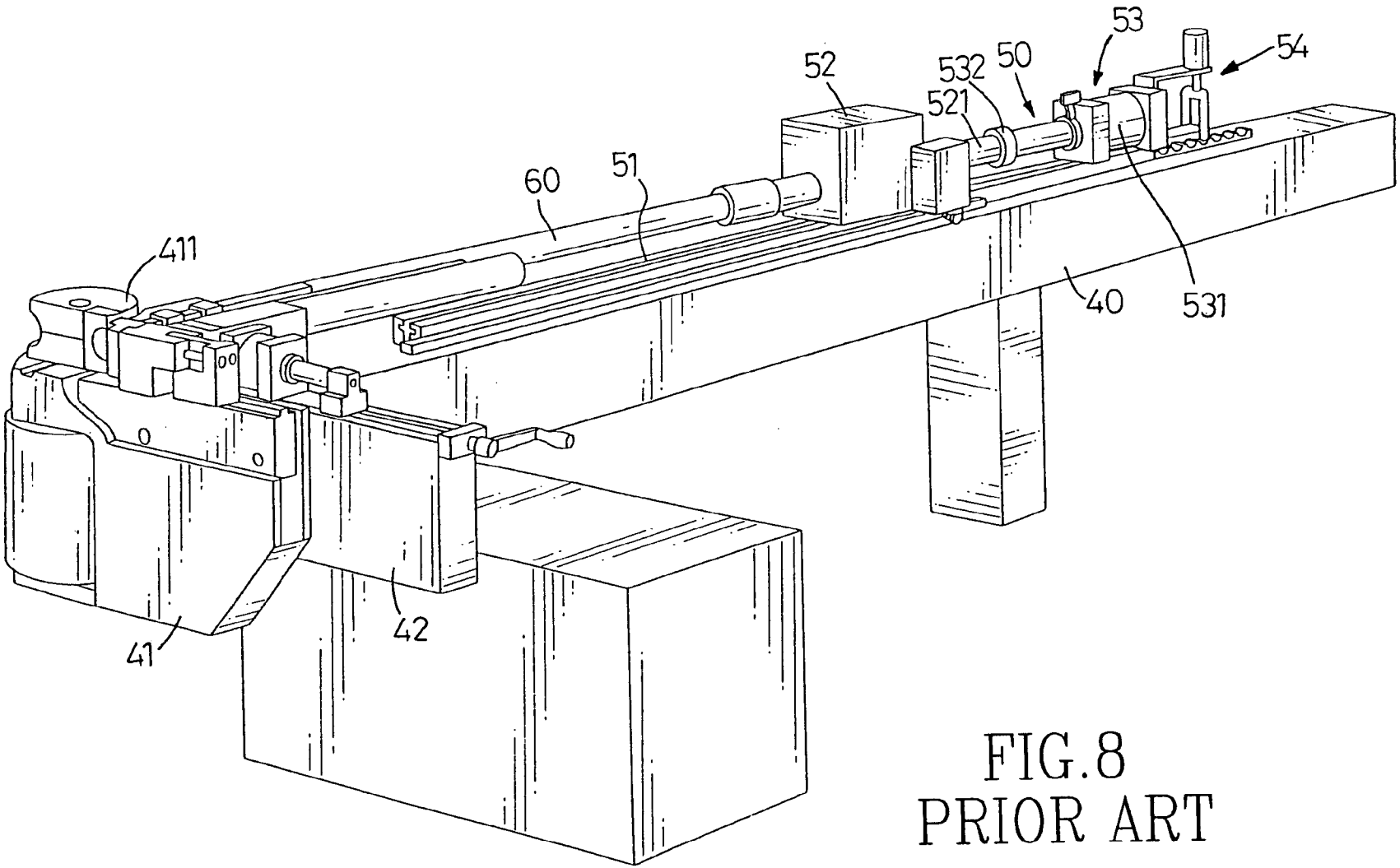
FIG.8 PRIOR ART
FIG. 8 is a perspective view of a conventional tube bending machine.
Figure 9:
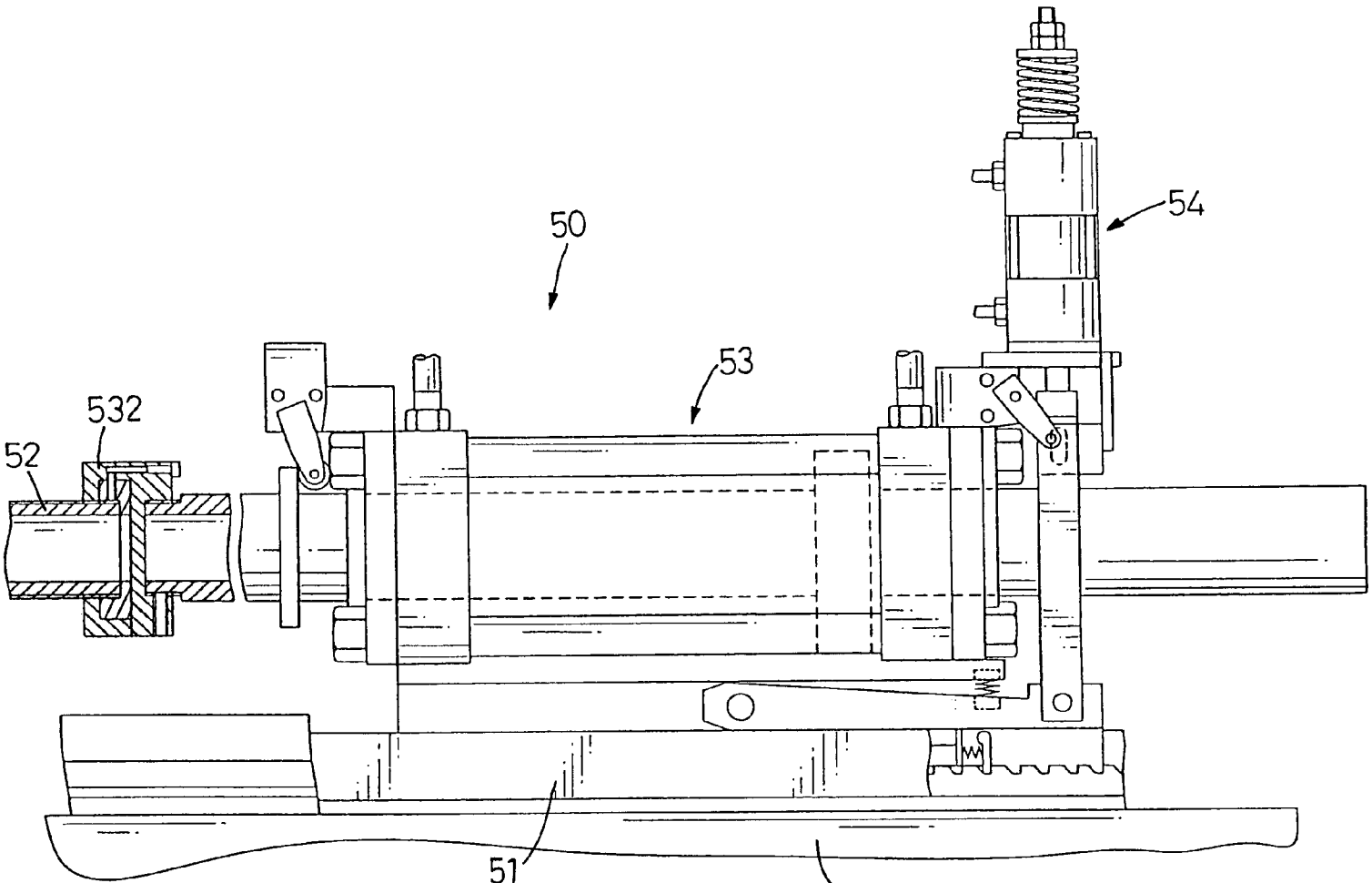
FIG. 9 PRIOR ART
FIG. 9 is a schematic side view of a portion of the conventional tube bending machine in FIG. 8.

With reference to FIGS. 6 and 7, another embodiment of the present invention is shown, wherein the transmission device (20) is substantially the same as that described earlier. The differences lie on the mounting position of the first power means (24) and the single rack (221) on the base (10). Therefore, the first transmission gear (242) is always engaged with the first rack (221) and the second power means (25) is controlled via the clutch (26) to alternatively connect to the first rack (221).

It is noted that the transmission device of the present invention has the following advantages:

1. High Process Quality

Due to the provision of the second motor, the drive force to the tube may be different according to the dimension of the tube so that the bending process is ensured.

2. Enlarging the Curvature Process Limitation of the Tube

Because the transmission device adopts motor transmission to cope with the clutch, the limitation on the curvature of the processing tube is eliminated.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A transmission device for a tube bending machine to transmit a workpiece to undergo a bending process, the transmission device comprising:

a guiding track assembly adapted to be mounted on top of a base of the tube bending machine and be parallel to a transmission direction of the workpiece;

a rack assembly adapted to be mounted on the base;

a sliding seat slidable along the guiding assembly and having a first power means with a first motor, and a second power means, both the first power means and the second power means mounted on the sliding seat to drive the sliding seat to move, a moving plate having a through hole defined through the moving plate to receive therein the second power means and a tube clamp mounted on top of the moving plate for clamping the workpiece; and a clutch mounted on a bottom face of the moving plate to alternately connect to the second power means and having an auxiliary bracket under the moving plate, wherein the first power means has a first motor on top of the moving plate to securely connect to a first transmission gear and the second power means has a second motor securely mounted on the auxiliary bracket to securely connect to a second transmission gear, wherein one end of the workpiece is in contact with the sliding seat and the other end of the workpiece is securely engaged with the tube bending machine such that movement of the sliding seat is controlled by the clutch so that when the second motor is activated to drive the sliding seat, the second transmission gear is securely engaged with the rack assembly and thus the sliding seat is able to move and the workpiece is bent by the movement of the sliding seat.

2. The transmission device as claimed in claim 1, wherein the rack assembly has a first rack mated with the first transmission gear and a second rack mated with the second transmission gear.

3. The transmission device as claimed in claim 1, wherein the rack assembly has a first rack to mate with the first transmission gear and to alternately mate with the second transmission gear.

4. The transmission device as claimed in claim 2, wherein the auxiliary bracket has an auxiliary sliding block mounted on a top of the auxiliary bracket to mate with an auxiliary guiding track on a bottom of the moving plate and be vertical to the second rack.

5. The transmission device as claimed in claim 3, wherein the auxiliary bracket has an auxiliary sliding block mounted on a top of the auxiliary bracket to mate with an auxiliary guiding track on a bottom of the moving plate and be vertical to the second rack.

* * * * *